United States Patent [19]

James

[11] Patent Number: 4,759,574

[45] Date of Patent: Jul. 26, 1988

[54] LATCH ASSEMBLY

[75] Inventor: Darrell L. James, Placentia, Calif.

[73] Assignee: Hartwell Corporation, Placentia, Calif.

[21] Appl. No.: 73,650

[22] Filed: Jul. 15, 1987

[51] Int. Cl.[4] ..... E05C 5/02

[52] U.S. Cl. ..... 292/113; 292/106; 292/DIG. 65; 292/1

[58] Field of Search ..... 292/108, 113, 216, 247, 292/DIG. 65, 210, 1, 106

[56] References Cited

U.S. PATENT DOCUMENTS

| | | | |
|---|---|---|---|
| 842,970 | 2/1907 | Parsons | 292/108 |
| 1,046,336 | 12/1912 | Schatz | 292/108 X |
| 2,322,948 | 6/1943 | Lofgren | 292/DIG. 5 X |
| 3,347,578 | 10/1967 | Sheehan et al. | 292/113 |

*Primary Examiner*—Richard E. Moore

*Attorney, Agent, or Firm*—Lyon & Lyon

[57] ABSTRACT

A latch assembly includes a hook having an opening engageable to a keeper. A side plate having a straight slot and an angle slot is mounted to the hook via posts. A spring is provided to bias the plate so that it partially overlaps the opening. The plate prevents a latch handle from being moved into its closed position unless the hook is fully engaged onto a keeper.

8 Claims, 1 Drawing Sheet

LATCH ASSEMBLY

BACKGROUND OF THE INVENTION

The field of the present invention is latch assemblies.

Latch assemblies are often used in a wide assortment of enclosures for retaining and securing doors or panels. Typically, a latch assembly is mounted onto a hinged door or panel and releasably engages a keeper or clasp mounted onto a fixed portion of an enclosure. Of course, the latch may alternatively be mounted onto the fixed part of the enclosure with the keeper mounted onto the door. The latch may be operated by a handle or lever on the exterior of the enclosure which drives the mutual engagement and disengagement of the latch and keeper. This configuration is frequently found, for example, on doors and panels or covers on equipment cabinets or containers, aircraft bodies, etc.

However, with latches of the aforementioned type, the door or panel may appear to be securely latched with the handle in the closed position, even when the latch and keeper are not engaged. Thus, a panel or door could inadvertently come open despite a visual inspection confirming that the latch handle is in the closed position. Accordingly, with known latches, a visual inspection of the position of the latch handle has generally been an unreliable indication as to whether the latch is fully and securely closed. Thus, other inspection and confirmation means have been required.

SUMMARY OF THE INVENTION

The present invention is directed to a latch assembly which prevents the latch handle from closing, if the latch is not properly and fully engaged with the keeper, while allowing the latch handle to close normally if the latch and keeper are properly and fully engaged. To this end, the latch assembly includes a hook having an opening engageable to a keeper, and two posts spaced apart from each other and protruding from the hook on opposite sides of the opening. A side plate having a first leg including a generally straight slot, and a second leg including an angle slot, is mounted onto the hook, with the posts engaging the slots.

The side plate is biased into an open position wherein the first leg at least partially overlies or occludes the opening, with the second leg simultaneously extending from the hook in an upright position and holding the latch handle away from the hook, thereby providing an indication that the latch is not securely closed. With the keeper fully engaged into the opening of the hook, the side plate can be rotated and shifted with respect to the hook such that the first leg is displaced out of the opening, and the second leg is moved into a lowered position permitting the handle to move closer to the hook and into its fully closed position, thereby providing an indication that the latch is indeed securely engaged.

Accordingly, it is an object of the present invention to provide a latch assembly which prevents the latch handle from closing and making the latch appear to be securely closed when the latch hook is not fully engaged with the keeper. Other and further objects and advantages will appear hereinafter.

BRIEF DESCRIPTION OF THE DRAWING

In the drawing, wherein similar reference characters denote similar elements throughout the several views.

DETAILED DESCRIPTION OF THE PREFERRED EMBODIMENT

Figure 1:
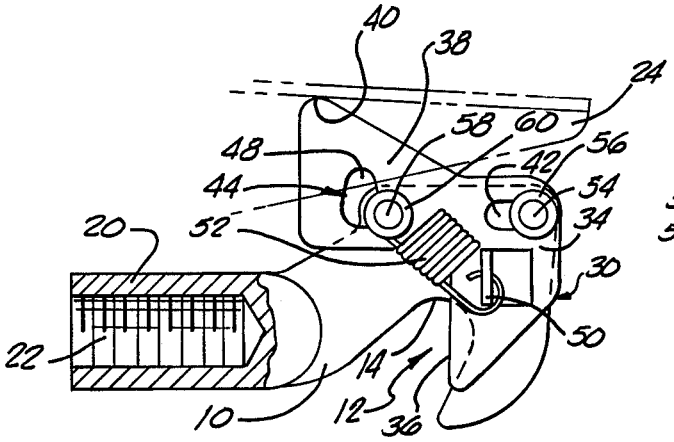
FIG. 1 is a side elevational view in part section of the latch assembly of the present invention in the open position.

Turning now in detail to the drawings, as shown in FIG. 1, the latch assembly of the invention includes a hook 10 having an opening 12 ending in a radius 14. The hook 10 includes a shank 20 having internal screw threads 22 to facilitate mounting.

Figure 2:
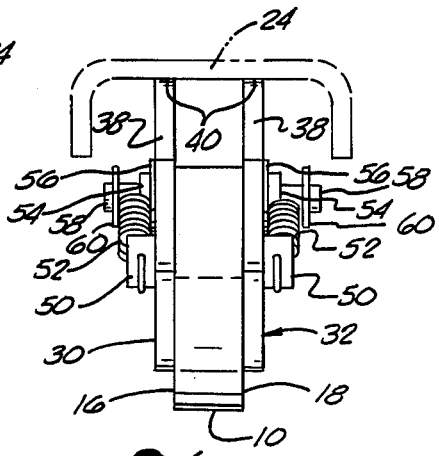
FIG. 2 is an end view thereof.

As illustrated in FIG. 2, the hook 10 has flat sides 16 and 18 from which extend a first post 54 having a flange 56, and a second post 58 with a flange 60. The first post 54 is disposed at the first end of the hook 10, while the second post 58 is positioned centrally on the hook, such that the two spaced apart posts 56 and 58 are generally on opposite sides of the hook opening 12. The posts 54 and 58 maybe individual bushings mounted separately on the hook sides 16 and 18.

Referring to FIGS. 1 and 2, the latch assembly further includes side plates 30 and 32. Each side plate has a first leg or section 34 having a straight slot 42 at the upper end thereof. The opposite end of each first leg 34 is preferably generally triangular, and includes a keeper butting surface 36 and a protruding tab 50. Integral with the first leg 30 of the side plates 30 and 32 is a second leg 38 extending generally perpendicular to the first leg and having a handle butting surface 40 at the upper end thereof, and a right angle slot 44 generally centrally located in the second leg 38.

The right angle slot 44 includes a first portion 46 aligned with and extending parallel to the straight slot 42, and a second portion 48 adjoining the first portion 46 and extending perpendicular thereto.

The side plates 30 and 32 may be mirror images of one another, with the only difference between the two side plates being the direction in which the tabs 50 protrude. As shown in FIGS. 1 and 2, the side plates 30 and 32 are mounted on opposite sides of the hook 10. The side plates 30 and 32 are each held onto the hook 10 by the first post 54 which passes through the straight slot 42, and by the second post 58 which passes through the right angle slot 44 of each side plate.

A tension spring 52 is disposed inbetween the second post 58 and the tabs 50. The spring 52 biases or pulls the side plates 30 and 32 into a latch open position, as shown in FIG. 1, wherein a portion of the first leg 34, specifically surface 36, partially overlies the opening 12. Also as shown in FIG. 1, with the side plates in this position, the plates 30 and 32 are positioned towards the shank 20 such that the first post 54 is disposed entirely towards one end of the straight slot 42, and similarly, the second post 58 is positioned entirely at the corresponding end of the first portion 46 of the angle slot 44. With the plates in this position, the second leg 38 extends away from the hook 10. Accordingly, the handle butting surface 40 prevents the handle 24 from moving towards the hook 10, such that the handle 24 cannot be moved into its closed position. In addition, due to the post and slot engagement, the plates in the position shown in FIG. 1 cannot pivot with respect to the hook, despite any force exerted on the plates by the handle 24.

Figure 3:
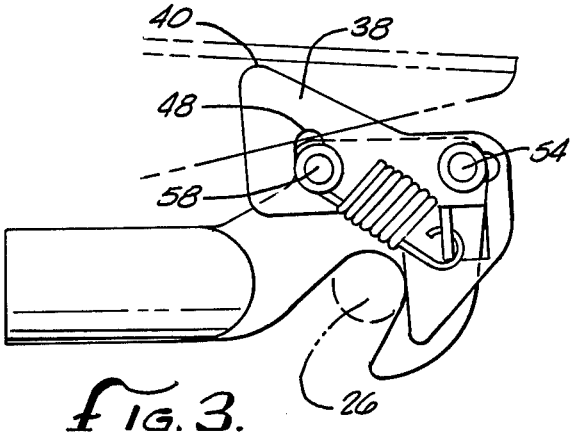
FIG. 3 is a side elevational view of the latch assembly of FIG. 1 in an intermediate position with the hook fully engaged onto the keeper and with the handle in the open position.

During the closing sequence of the latch assembly, the keeper 26 and the hook opening 12 are engaged, as illustrated in FIG. 3. The force mutually engaging the keeper 26 into the opening 12 pushes on the butting surface 36 of each of the plates 30 and 32 causing the plates to be moved against the force of the spring 52 towards the first end of the hook 10. As can be seen in FIG. 3, with the latch in this intermediate position, the plates 30 and 32 are displaced such that the first post 54 is now at the other end of the straight slot 42, and similarly, the second post 58 is at the corresponding other end of the first portion 46 of angle slot 44, i.e. at the junction of the first portion 46 and the second portion 48 of angle slot 44, with the handle 24 being in the open position.

Figure 4:
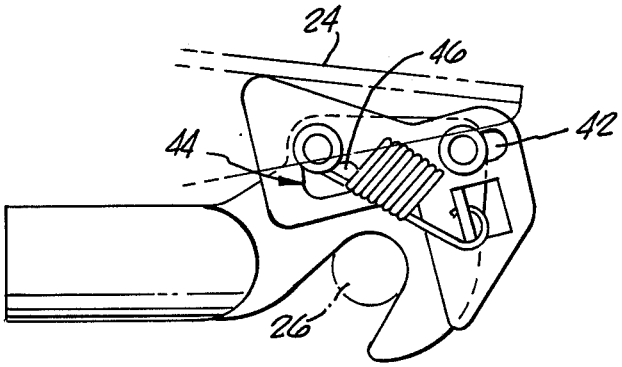
FIG. 4 is a side elevational view of the latch assembly of FIG. 1 in the closed position.

However, as the keeper 26 is now completely and securely engaged within the opening 12 of the hook 10, and the second portion 48 of the angle slot 44 is disposed over the second post 58, the handle 24 can be freely moved towards the hook 10 into its fully closed position, as shown in FIG. 4. As this handle movement occurs, the plates 30 and 32 are pivoted about the first post 54 and the second leg 38 is moved counterclockwise, and the uppermost section of the second portion 48 of the angle slot 44 is positioned against the second post 58. Simultaneously, the butting surface 36 of the first leg 34 of each plate is moved away from the hook opening 12, such that the surface 36 is no longer engaged against the keeper 26.

From the foregoing description, it can be appreciated that the handle 24 can only be placed into its fully closed position, as shown in FIG. 4, when the keeper 26 is fully engaged into the opening 12 of the hook 10. Therefore, if the keeper 26 is entirely disengaged, or only partially engaged into the opening 12, the handle 24 will be prevented from moving into its closed position. Accordingly, if the visual inspection of the latch handle 24 reveals the handle to be in its closed position, the hook 10 and keeper 26 must be fully engaged. Therefore, a visual inspection is sufficient to ensure that the latch is securely engaged and closed. Furthermore, the above-described latch does not require any resetting after opening, has minimal space requirements, and is adaptable to most latch applications.

Thus, a latch assembly is disclosed which automatically provides an indication that the latch is not engaged. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A latch assembly comprising:

a hook having an opening engageable to a keeper;

a first post and a second post spaced apart from each other, said first post attached to said hook on one side of said opening and said second post attached to said hook on the other side thereof;

a side plate having a first leg and a second leg, said first leg including a generally straight slot and said second leg including an angle slot, said side plate mounted on said hook with said first post engaging said first slot and said second post engaging said angle slot; and biasing means for urging said side plate into an open position.

2. The latch assembly of claim 1 wherein said angle slot has a first slot section aligned with and parallel to said straight slot, and a second slot section adjoining said first slot section and extending perpendicular thereto.

3. The latch assembly of claim 1 wherein said first leg and said second leg are generally triangular.

4. The latch assembly of claim 1 wherein said means for biasing comprises a tension spring.

5. The latch assembly of claim 4 wherein one end of said spring is attached to said second post and the other end thereof is attached to said first leg.

6. A latch assembly comprising:

a generally planer hook having an opening engageable to a keeper;

a pair of first posts mounted onto either side of said hook on one side of said opening;

a pair of second posts mounted on either side of said hook on the other side of said opening opposite to said pair of first posts;

a pair of side plates, each plate of said pair having a first leg and a second leg, said first leg including a straight slot and said second leg including an angle slot having a first slot section in alignment with and parallel to said straight slot, and a second slot section adjoining said first section and extending at an angle thereto;

said pair of side plates mounted onto opposite sides of said hook with said first posts engaging said straight slots and said second posts engaging said angle slots; and biasing means for urging said side plates into an open position.

7. The latch assembly of claim 6 wherein said opening is disposed at an angle with respect to a line joining said first and second pairs of posts.

8. The latch assembly of claim 6 wherein said first pair of posts are dimensioned to slidably engage said straight slot and said second pair of posts are dimensioned to slidably engage said angle slot.

* * * * *